US012258725B2

(12) United States Patent
Ryan et al.

(10) Patent No.: US 12,258,725 B2
(45) Date of Patent: Mar. 25, 2025

(54) ENVIRONMENT RESTRICTED FRONT BUCKET LOADER WITH MATERIAL HANDLING

(71) Applicant: John Ryan Farms LLC, Montgomery, IN (US)

(72) Inventors: Robert J. Ryan, Cannelburg, IN (US); John N. Ryan, Montgomery, IN (US)

(73) Assignee: John Ryan Farms LLC, Montgomery, IN (US)

( * ) Notice: Subject to any disclaimer, the term of this patent is extended or adjusted under 35 U.S.C. 154(b) by 762 days.

(21) Appl. No.: 17/470,672

(22) Filed: Sep. 9, 2021

(65) Prior Publication Data

US 2023/0072329 A1 Mar. 9, 2023

(51) Int. Cl.
*E02F 3/40* (2006.01)
*E02F 3/407* (2006.01)
*E02F 3/42* (2006.01)

(52) U.S. Cl.
CPC ..... *E02F 3/407* (2013.01); *E02F 3/422* (2013.01)

(58) Field of Classification Search
CPC ..... E02F 3/407; E02F 3/42; E02F 3/34; E02F 3/422
See application file for complete search history.

(56) References Cited

U.S. PATENT DOCUMENTS 2,701,072 A 2/1955 Chambers et al.
2,720,990 A 10/1955 Beyerstedt et al.
(Continued)

FOREIGN PATENT DOCUMENTS

DE 202015106899 U1 1/2016
DE 202020001195 U1 4/2020
(Continued)

OTHER PUBLICATIONS

Mining Techonology, Custom Mining Products, Publication date Nov. 13, 2019. https://www.mining-technology.com/contractors/pumps/custom-mining-products/.
(Continued)

*Primary Examiner* — Thomas B Will
*Assistant Examiner* — Robert E Pezzuto
(74) *Attorney, Agent, or Firm* — Bryan L. Baysinger; Maynard Nexsen PC

(57) ABSTRACT

A front bucket loader apparatus for operating in low overhead space environments comprises a front bucket with a bottom plate with a front edge, an opposing back edge, a left edge and an opposing right edge. The front bucket further has a left side wall attached to the left side of the bottom plate and a right side wall attached to the right side of the bottom plate. Further, it is configured with a top support bracket attached to the left side wall and to the right side wall. Further, the front bucket has a pivotable serpentine back wall, the pivotable serpentine back wall having an upper portion and a lower portion, the upper portion being supported by the top support bracket and the lower portion of the pivotable serpentine back wall configured for engaging the bottom plate of the front bucket. Lastly the front bucket has a slatted rear mount directly opposing the pivotable serpentine back wall. The front bucket loader further comprises a hydraulic assembly attached to the slatted rear mount of the front bucket and operatively connected to the pivotable serpentine back wall of the front bucket.

13 Claims, 10 Drawing Sheets

(56) References Cited

U.S. PATENT DOCUMENTS

| | | | | |
|---|---|---|---|---|
| 2,806,617 | A | 9/1957 | Beyerstedt et al. | |
| 2,864,518 | A | 12/1958 | Beyerstedt | |
| 2,885,103 | A | 5/1959 | Cunningham, Jr. | |
| 3,035,724 | A | 5/1962 | Clark et al. | |
| 3,048,292 | A | 8/1962 | Kohorst et al. | |
| 3,122,248 | A | 2/1964 | Campbell et al. | |
| 3,176,863 | A | 4/1965 | Kuhl | |
| 3,421,236 | A | 1/1969 | Moyer | |
| 3,426,928 | A | 2/1969 | Campbell | |
| 3,523,621 | A | 4/1970 | Anderson et al. | |
| 3,539,069 | A | 11/1970 | Allen et al. | |
| 3,543,960 | A | 12/1970 | Wagner | |
| 3,642,160 | A | 2/1972 | Rockwell et al. | |
| 3,837,516 | A | 9/1974 | Meyer | |
| 3,937,345 | A | 2/1976 | Countryman | |
| 4,144,980 | A * | 3/1979 | Meyer | F15B 15/149 414/704 |
| 4,349,308 | A | 9/1982 | Buckstead et al. | |
| 5,603,382 | A | 2/1997 | McIver | |
| 5,702,227 | A | 12/1997 | Berg | |
| 8,857,080 | B1 * | 10/2014 | Sutter | E02F 3/407 414/416.04 |
| 9,139,976 | B2 | 9/2015 | Goldspink | |
| 10,662,611 | B1 | 5/2020 | Mohns | |
| 2005/0193601 | A1 * | 9/2005 | King | E02F 3/407 37/411 |

FOREIGN PATENT DOCUMENTS

| | | | |
|---|---|---|---|
| FR | 1578047 | A | 8/1969 |
| GB | 919219 | A | 2/1963 |
| GB | 975087 | A | 11/1964 |
| GB | 982816 | A | 2/1965 |
| GB | 1197821 | A | 7/1970 |
| GB | 2064473 | A | 6/1981 |

OTHER PUBLICATIONS

Murray Machinery, Ejector Bucket for Biomass Boilers, Publication date Nov. 5, 2017. https://www.murraymachinery.com/products/ejector-bucket-for-biomass-boilers.

Rochland, Ejector/Push-Out Bucket. https://rocklandmfg.com/product/mining-bucket/.

Hitchdoc, Push-Off Bucket, Publication Date Dec. 22, 2018. https://www.hitchdoc.com/push-off-bucket.php.

AMI Attachments, Kickbox Ejector Bucket, Publication date Aug. 4, 2020.https://www.amiattachments.com/product/ejector-bucket/.

Aramine Group, Ejector Bucket, Publication date May 18, 2015. https://www.youtube.com/watch?app=desktop&v=AT-7aRBCND8.

Bruce Johnson, Self Dumping Loader Bucket Now on Market, Publication date Aug. 7, 2014. https://www.farmshow.com/a_article.php?aid=2389.

Craig Manufacturing Ltd., St-Scb Ejector Bucket, Publication date Aug. 5, 2017. https://www.craigattachments.com/products/loader/loader-buckets/ejector-bucket/.

Attachments International. Ejector Buck, Publication date Mar. 12, 2013. http://attachmentsintl.com/skid-steer-attachments/skid-steer-buckets/.

Dymax, Inc. Pushout Buckets, Publication date Jan. 19, 2021. https://dymaxinc.com/attachments/pushout-buckets/#pushout-buckets.

Masterhitch Europe, Ltd, Ejector Buckets, Publication date Nov. 20, 2020. http://www.masterhitch.co.uk/ejector-buckets/.

Farm 2000, Push Off Buckets. https://www.farm2000.co.uk/push-off-buckets/.

* cited by examiner

ENVIRONMENT RESTRICTED FRONT BUCKET LOADER WITH MATERIAL HANDLING

FIELD

The present invention relates to front bucket loaders, and in particular front bucket loaders that allow material handling in low overhead space environments such as turkey houses and chicken houses.

BACKGROUND

Front bucket loaders are improvements to material handling that can be mounted onto a variety of vehicles. Typical vehicles include skid steer's, tractors, bull dozers, and other heavy machinery. Front bucket loaders are typically driven by hydraulic pistons and throughout the years new and improved front bucket loaders have increased the usability and specialization of front bucket loaders.

In 1965 International Harvestor™ filed and received U.S. Pat. No. 3,209,474 for a Tractor Loader with Pivotal Scoop Portion. International's invention disclosed an improvement in the front bucket loader by allowing the bucket to perform the traditional function of digging with an additional function of bull dozing. Continuing, in 1968 Caterpillar Tractor Co.™ filed for U.S. Pat. No. 3,523,621 for an Ejector for a Loader Bucket. Caterpillar's ejector focused on ejecting bulk material with a piston directly connected to a back wall. Further, in 1970 Allis Chalmers Mfg. Corp.™ filed for and received U.S. Pat. No. 3,642,160 for a Loader with Ejector-Type Bucket. Allis Chalmers' loader bucket ejector similarly had a single piston attached to a back wall, but also disclosed a multiple piston beam apparatus for moving the load vertically as well as tilting the bucket.

The field of front bucket loaders as well as moving materials has advanced, including new types of front loader buckets for special purpose use and special material use. However, a front bucket loader that is unique to low overhead environments such as chicken and turkey houses, and that is equipped with an ejector means to efficiently and effectively handle animal waste materials, is something that remains a long sought need. Therefore, the disclosure herein provides an improved front bucket loader for usage where material handling is specialized, and overhead height is at a minimum, further wherein the environment lacks the ability to maneuver the vehicle due to space constraints and material constraints.

SUMMARY

In one aspect, a front bucket loader apparatus for operating in low overhead space environments is disclosed. The front bucket loader comprises a front bucket with a bottom plate with a front edge, an opposing back edge, a left edge and an opposing right edge. The front bucket further has a left side wall attached to the left side of the bottom plate and a right side wall attached to the right side of the bottom plate. Further, it is configured with a top support bracket attached to the left side wall and to the right side wall. Further, the front bucket has a pivotable serpentine back wall, the pivotable serpentine back wall having an upper portion and a lower portion, the upper portion being supported by the top support bracket and the lower portion of the pivotable serpentine back wall configured for engaging the bottom plate of the front bucket. Lastly the front bucket has a slatted rear mount directly opposing the pivotable serpentine back wall. The front bucket loader further comprises a hydraulic assembly attached to the slatted rear mount of the front bucket and operatively connected to the pivotable serpentine back wall of the front bucket. The front bucket loader has an upper swing arm having a first end and a second end, the first end of the upper swing arm attached to a rear mount of the front bucket, the second end of the upper swing arm attached to a hydraulic piston. It further has a lower swing arm having a first end and a second end; the first end of the lower swing arm attached to the second end of the upper swing arm, and the second end of the lower swing arm attached to the lower portion of the pivotable serpentine back wall. Lastly, it is configured with a hydraulic means for moving the upper swing arm in an arcuate path to move the lower swing arm, attached to the pivotable serpentine back wall, along the bottom plate of the front bucket, wherein the hydraulic means is operatively configured below the top of the front bucket.

BRIEF DESCRIPTION OF THE DRAWINGS

Many aspects of the present disclosure can be better understood with reference to the following drawings. Unless otherwise specifically noted, articles depicted in the drawings are not necessarily drawn to scale. Rather, emphasis is instead being placed upon clearly illustrating the principles of the disclosure. Moreover, in the drawings, like reference numerals designate corresponding parts throughout the several views.

DETAILED DESCRIPTION

Figure 1:
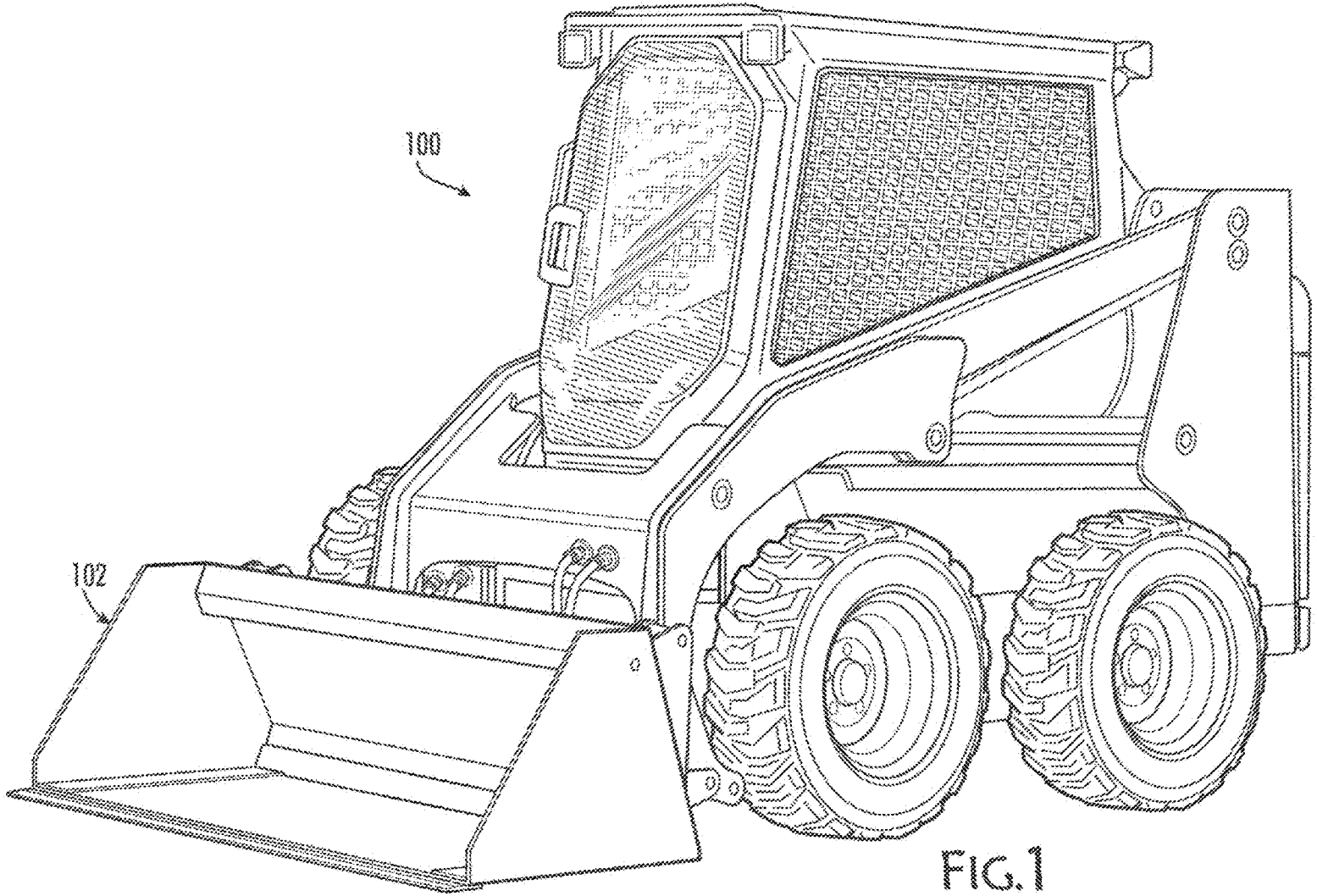
FIG. 1 is an illustration of an example embodiment of a skid-steer with a front bucket loader.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting, but are examples of embodiments of the disclosure herein. Other embodiments may be utilized, and other changes may be made, without departing from the scope of the subject matter presented herein. It will be readily understood by those with skill in the art that the aspects of the present disclosure, as generally described herein, and illustrated in the figures, can be arranged, substituted, combined, separated, and designed in a wide variety of different configurations, all of which are explicitly contemplated herein.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Front bucket loaders are often used to dig materials either through a bull dozer type of plow configuration by pushing the material, a claw type apparatus for pinching the material, or by scooping the material. The basis is material movement, and throughout the year's innovators have worked to develop new specialized means for material handling. For example, a tooth bar was incorporated on the front bucket loader to allow breaking up of material and clasping and pulling objects. A claw like apparatus was developed to turn a traditional front bucket loader into an excavator style bucket. Ejectors were introduced to automatically remove material without having to tilt the bucket. However, today's ejectors lack specialized field of use as well as configuration of the front bucket apparatus to handle such environments.

We begin our review of the drawings with FIG. 1, an illustration of an example embodiment of a skid steer with a front bucket loader apparatus. In the example a compact loader, often referred to as a skid steer or skid loader, is disclosed. Compact loaders, such as vehicles made and manufactured by Bobcat™ and Caterpillar™ are designed as a small rigid-frame machine with lift arms that can attach a wide variety of labor saving tools. These loaders are constructed with a variety of configurations and attachments. For example, a compact loader may have rubber tires, or rubber tracks, or metal tracks. As well as attachments that can range from and auger to a tree grapple. An example of the various attachments can be found on the manufacturers website, e.g. https://www.bobcat.com/attachments/.

The front attachments of skid steer's may be connected to an auxiliary hydraulic assembly. The most common system is a standard-flow auxiliary hydraulics package. The flow rates of such a package differ by manufacturer, but typically range from 17 to 24 gallons per minute (gpm) that equates to around 3,000 to 5,000 pounds per square inch (psi) of pressure. A high flow hydraulic system is an option from most manufacturers that increases the flow rate to around 30-38 gpm, while maintaining similar pressure. High flow hydraulic systems enable higher performance for tasks that require more power, such as ground foliage clearing or rock breaking attachments.

In the example of FIG. 1 a rubber wheel based skid steer 100 is depicted with an example front bucket loader 102. The front bucket loader 102 mounts to the skid steer 100 with a 3-point assembly (depicted later) and connects to the auxiliary hydraulic assembly of the skid steer 100. Disclosed within FIG. 1 the hydraulics assembly is behind the front loader bucket and thus not interfering with overhead obstacles. The disclosure herein is provided to operate within chicken and turkey houses, where the environment has a low overall ceiling height and the skid steer is severely restricted in maneuverability.

Figure 2A:
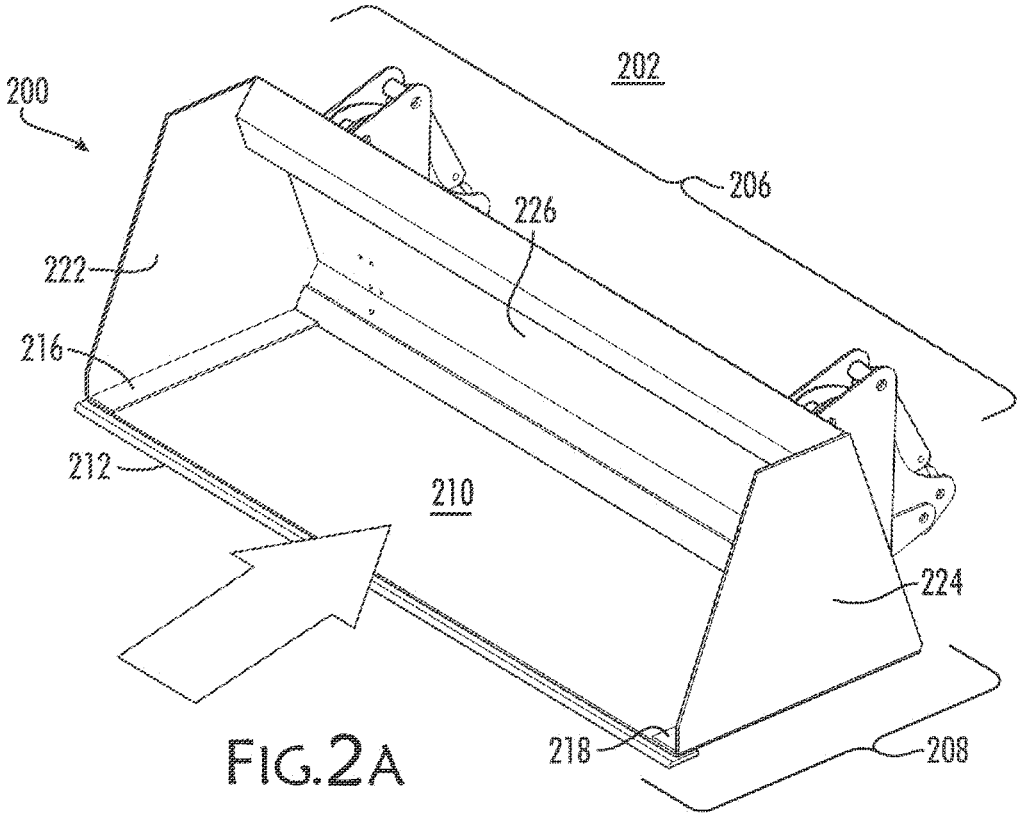
FIG. 2A is an illustration of an example embodiment of a front bucket loader in a retracted position.
Figure 2B:
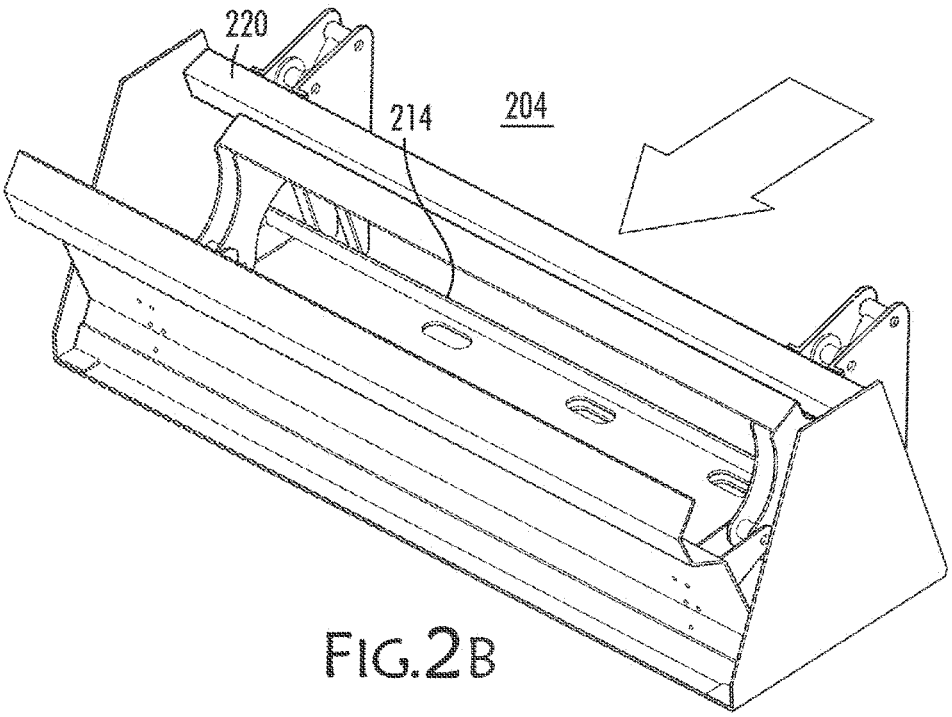
FIG. 2B is an illustration of an example embodiment of a front bucket loader in a protracted position.

Turning now to FIGS. 2A and 2B, FIG. 2A is an illustration of an example embodiment of a front bucket loader 200 in a retracted position 202, and FIG. 2B is an illustration of an example embodiment of a front bucket loader in a protracted position 204. The examples show the movement of the front bucket loader when ejecting or depositing materials. In the example, the material is chicken and turkey waste product, wherein the design allows for accommodating the environment in which the skid steer is able to retrieve the material and eject the material. The hydraulic assembly 206 of the front bucket loader is configured to the auxiliary hydraulic assembly of the skid steer to power the pistons that drive the bucket to a protracted and retracted state.

In the example of FIGS. 2A and 2B, the front bucket loader 200 is equipped with a hydraulic assembly 206 to drive the pivotable serpentine back wall from a retracted position 202 to a protracted position 204 to eject or remove or dispense material. The pivotable serpentine back wall 226 moves along the bottom plate 210, from the back edge 214 of the bottom plate to the front edge 212 of the bottom plate. The pivotable serpentine back wall 226 is further bordered by the left side wall 222 and the right side wall 224, in additional embodiments the left and right side wall have a bar wherein the bar holds the pivotable serpentine back wall 226 within horizontal position as it moves laterally to a protracted and retracted position.

In the example the front bucket is comprised of a steel alloy. Further, the front edge 212 of the bottom plate may also be equipped with a tooth bar that allows for scraping or may have a sloped edge to assist in scooping material. The front edge 212 may also be beveled or otherwise contoured to facilitate the scooping or pushing of material. The lower portion of the pivotable serpentine back wall 226 engages the bottom plate 210, wherein the bottom plate 210 may have a billeted or open foramen back edge 214 to prevent material from collecting and blocking the return of the pivotable serpentine back wall 226 to a retracted state 202.

Figure 3A:
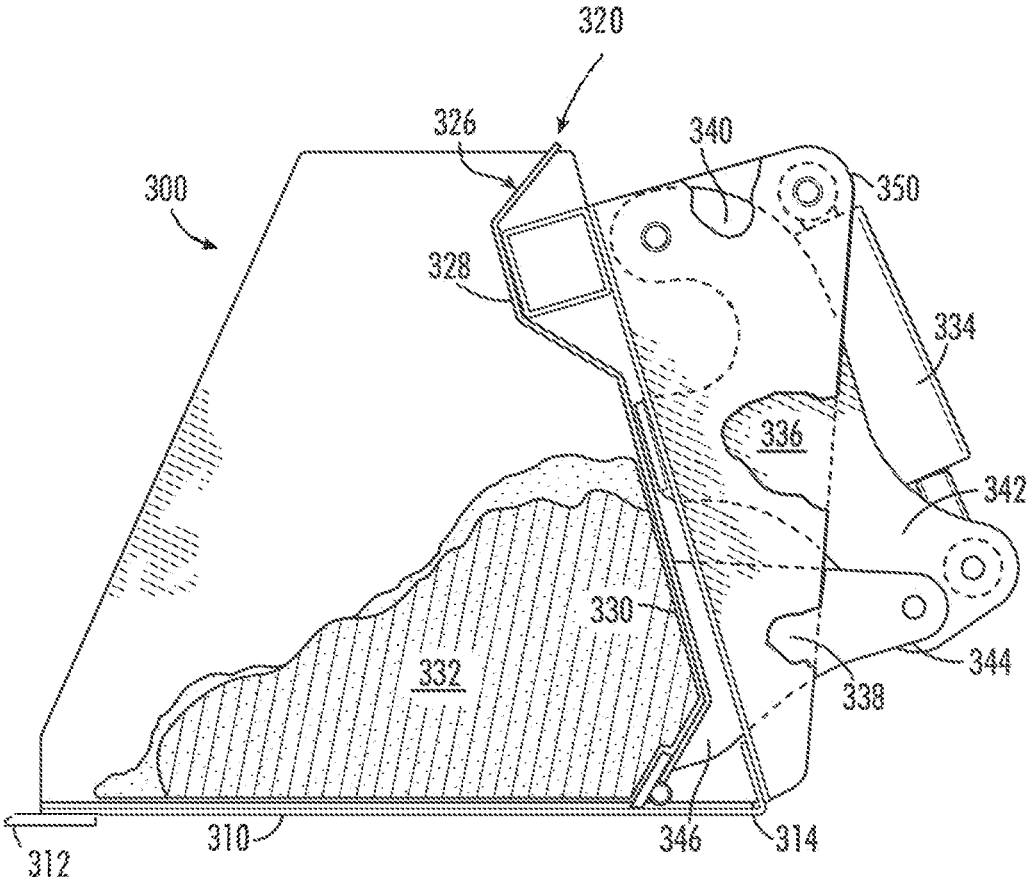
FIG. 3A is an illustration of a side view of an example embodiment of a front bucket loader in a retracted position.
Figure 3B:
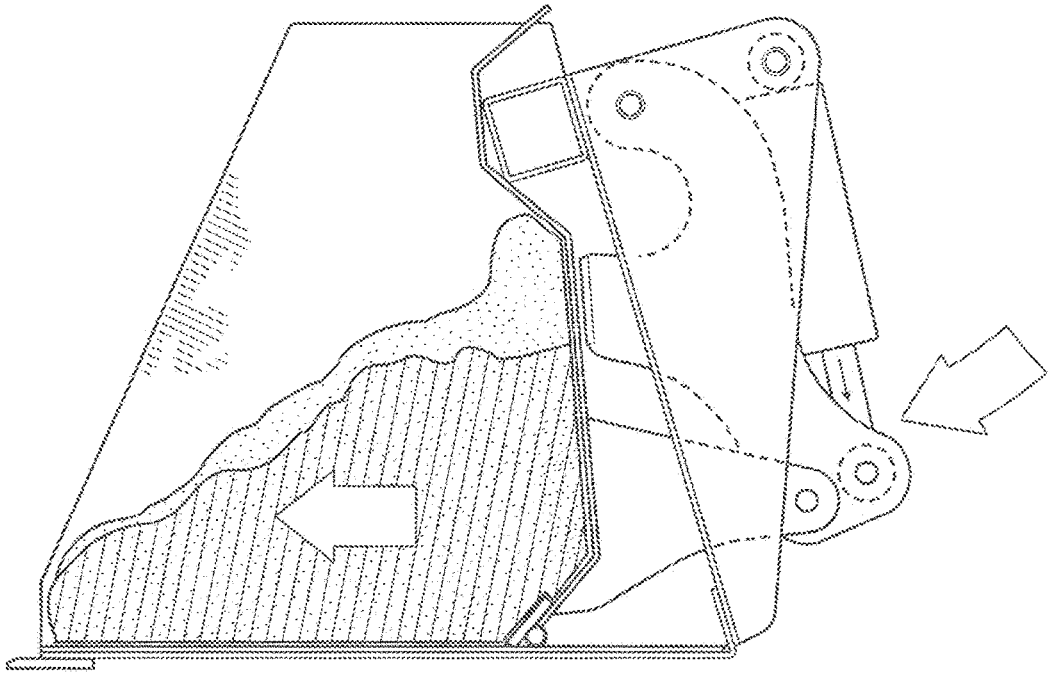
FIG. 3B is an illustration of a side view of an example embodiment of a front bucket loader activating the movement to unload material.
Figure 3C:
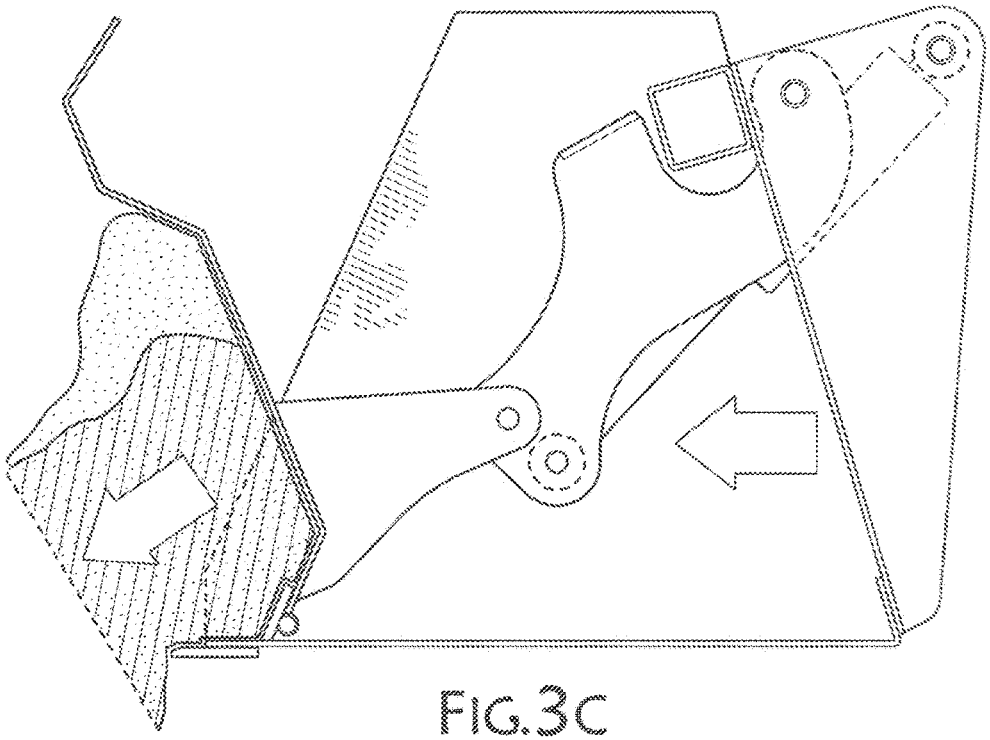
FIG. 3C is an illustration of a side view of an example embodiment of a front bucket loader at a full state of activation in unloading material.
Figure 3D:
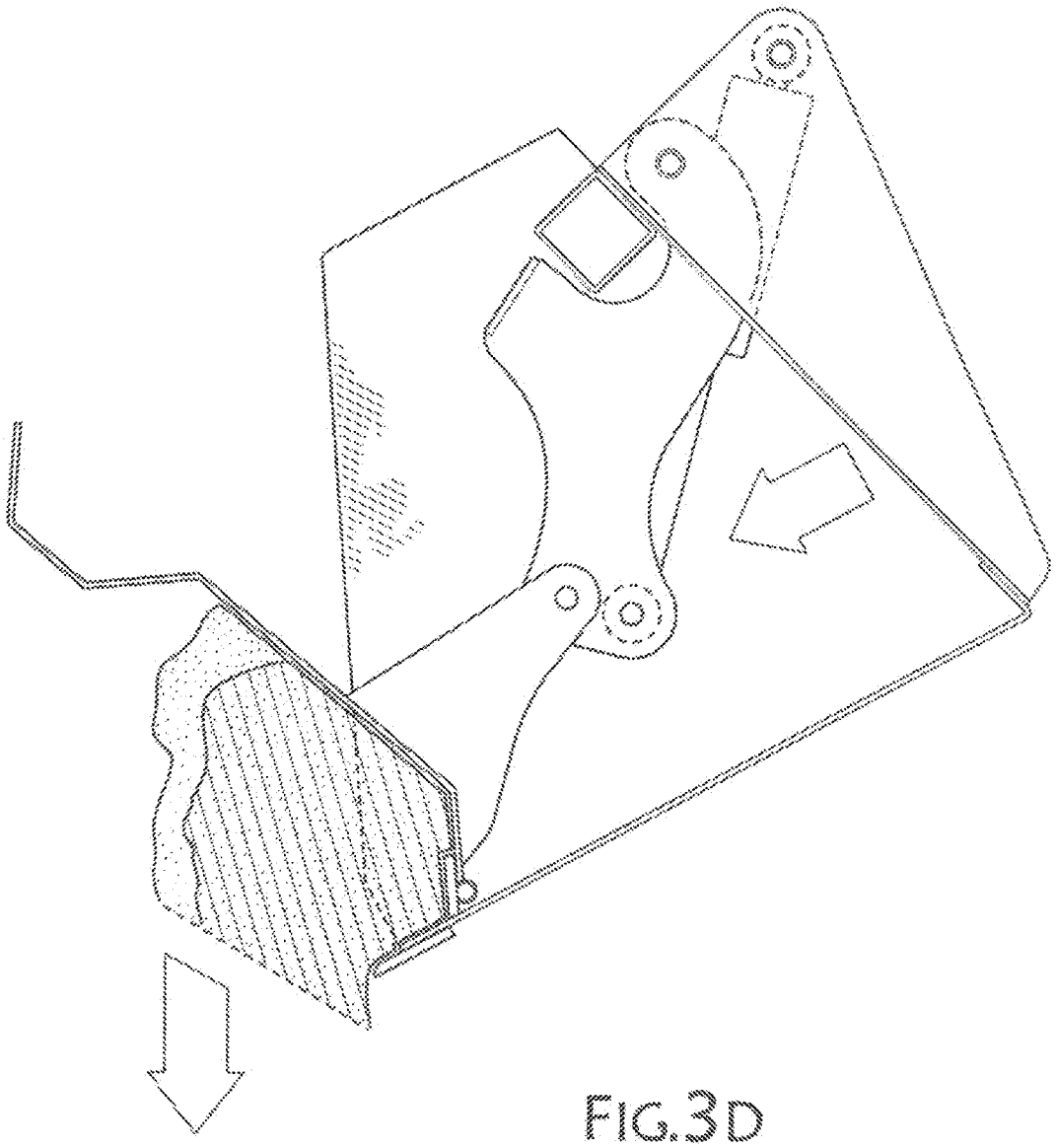
FIG. 3D is an illustration of a side view of an example embodiment of a front bucket loader at a state of activation and tilt in unloading material.

Referring now to FIGS. 3A-D illustrating an example embodiment of the front bucket loader ejecting material in a series of illustrations (FIGS. 3A-D). FIG. 3A is an illustration of a side view of an example embodiment of a front bucket loader in a retracted position. FIG. 3B is an illustration of a side view of an example embodiment of a front bucket loader activating the movement to unload material. FIG. 3C is an illustration of a side view of an example embodiment of a front bucket loader at a full state of activation in unloading material. FIG. 3D is an illustration of a side view of an example embodiment of a front bucket loader at a state of activation and tilt in unloading material.

FIGS. 3A-D include a front bucket loader 300, wherein the dimensions may range from a maximum of 32 inches in height and a minimum width of 60 inches to a maximum width of 96 inches. Load capacities can vary, depending on the alloy of the front loader bucket, as well as the configuration, e.g. ranges may be from 16 to 58 cubic feet. The following chart is a set of example bucket sizes for the disclosure herein:

| Example Front Bucket Dimensions and Capacity (Approx.) | | |
|---|---|---|
| Width (inches) | Height (inches) | SAE Heaped Bucket Capacity (FT3) |
| 60 | 32 | 16 |
| 66 | 32 | 20 |
| 72 | 32 | 25 |
| 80 | 32 | 30 |
| 96 | 32 | 36 |

In the example of FIGS. 3A-D, the front bucket loader 300 begins in FIG. 3A with material loaded and in a horizontal and retracted position. The bottom plate 310 bears the weight of the material and the front edge 312 is the area the material moves toward when ejecting or depositing. The bottom plate 310 is configured with a back edge 314, wherein the back edge 314 may be billeted for materials to fall through. The back edge 314 may further have a reinforced back lip or upper portion to the back edge 314 that builds rigidity into the bucket and allows for the pivotable serpentine back wall 326 to rest against when pushing into heavier or more concentrated materials.

The bottom plate 310 is configured to the left and right side walls, wherein the two side walls connect across the top portion to a top support bracket 320. The top support bracket 320 is a hollow square tube providing stability and support to the upper portion 328 of the pivotable serpentine back wall 326. The unique curvature of the pivotable serpentine back wall 326 allows materials to roll forward while also having a brace at the upper portion 328 with a top support bracket 320 and at the lower portion 330 against the second end of the lower swing arm 338. Thereby increasing the bearing capacity of the pivotable serpentine back wall 326 while ensuring a linear movement when retracting to deposit or eject materials. The upper portion 328 of the pivotable serpentine back wall 326 allows material to roll unto itself and when ejecting functions in a similar fashion as when scooping or loading or pushing. The mechanics allow for material to fluidly roll unto itself, rather than accumulate along a slope, the distinguished 45 degree angles that are braced by the top support bracket 320 build strength and allow for rolling of materials.

Continuing with FIGS. 3A-D, the rear mount 350 is located at the rear of the front bucket loader 300 and configured with the top support bracket 320, along with the left and right side walls, and the bottom plate 310 near the back edge 314 of the bottom plate 310. Further, a slatted rear mount (depicted in FIGS. 5-6) may also configure with the rear mounts 350. The rear mounts 350 also serve to protect the hydraulic means and hydraulic assembly by maintaining the hydraulic pistons 334 within the confines of the walls of the rear mounts (350).

The hydraulic piston 334 is configured to the auxillary hydraulic system of the skid steer or compact loader, wherein the skid steer provides the hydraulic pressure to drive the piston that allows the bucket to move from a retracted state to a protracted state to deposit materials. Materials in this disclosure refers to chicken and turkey coop waste products, along with feed and other waste products. In additional embodiments, materials may mean earth materials, such as soil or aggregate, or may mean other waste materials that may be generated within a facility with low overhead space and small confines. Environment within this disclosure means the location wherein the skid steer operates, a typical environment may be chicken or turkey houses or barns, along with other low overhead space environments.

The hydraulic piston 334 is configured to the rear mount 350 and the second end 342 of the upper swing arm 336. The upper swing arm 336 has two ends, a first end 340 configured to the rear mount 350 and a second end 342 configured to the hydraulic piston 334 and the first end 344 of the lower swing arm 338. The lower swing arm has two ends, a first end 344 of the lower swing arm 338 configured to the second end 342 of the upper swing arm, and a second end 346 of the lower swing arm attached or configured to the lower portion 330 of the pivotable serpentine back wall 326. The upper and lower swing arm function to move the pivotable serpentine back wall 326, with the pressure from the hydraulic piston 334. The upper swing arm 336 moves in an arcuate path as it arcs or orbits the lower swing arm 338 then drives the pivotable serpentine back wall 326 in a lateral motion either forward or backward (protracted or retracted state). The lower swing arm 338 moves along a single axis as it drives the pivotable serpentine back wall. 326.

Stepping through FIGS. 3A-D, we see in FIG. 3A a resting position, also known as fully retracted, wherein the load may first be acquired and the front bucket filled with material 332. Next, in FIG. 3B, the hydraulic piston 334 is engaged and the force on the second end 342 of the upper swing arm 336 begins to drive the lower swing arm 338 into the pivotable serpentine back wall 326 that glides along the bottom plate 310 moving the material 332 towards the front edge 312. In FIG. 3C a fully extended state is achieved with the material being ejected from the front edge 312 of the bottom plate 310. In a fully extended state the upper swing arm 336 is engaged to stop with the top support bracket 320 to prevent over extension of the hydraulic piston 334. As disclosed in FIG. 3 C the pivotable serpentine back wall 326 allows the material 332 to roll unto itself as it is being ejected or pushed from the front bucket. FIG. 3D further discloses a tilt feature, wherein the front bucket is tilted and the material 332 is ejected due to gravity or the force directed unto it from the tilt of the bucket.

Figure 4A:
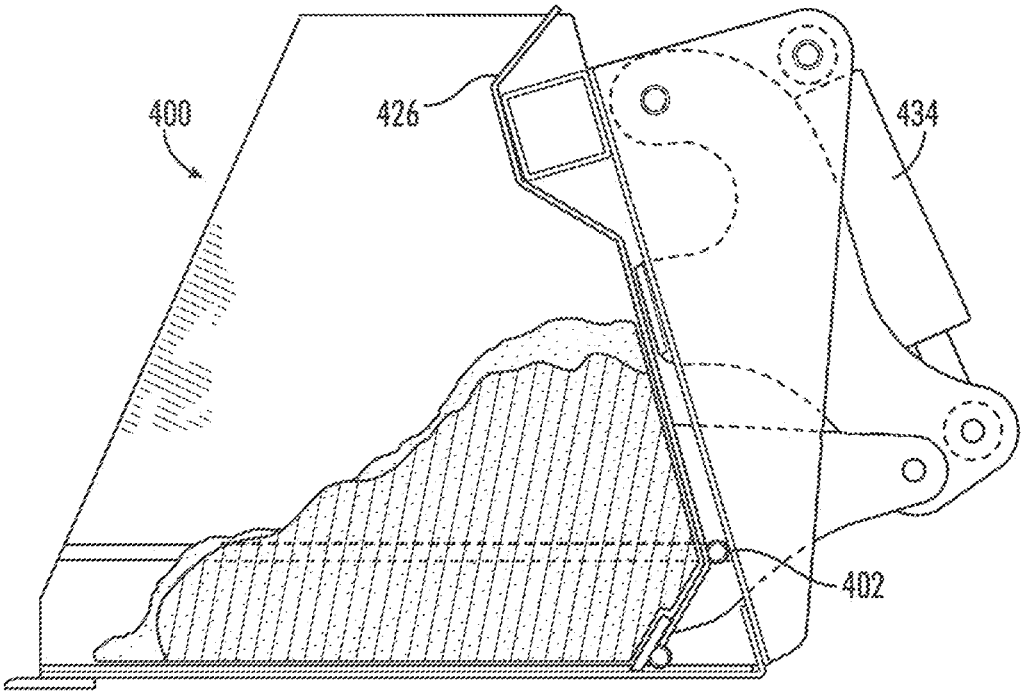
FIG. 4A is an additional illustration of a side view of an example embodiment of a front bucket loader in a retracted position.
Figure 4B:
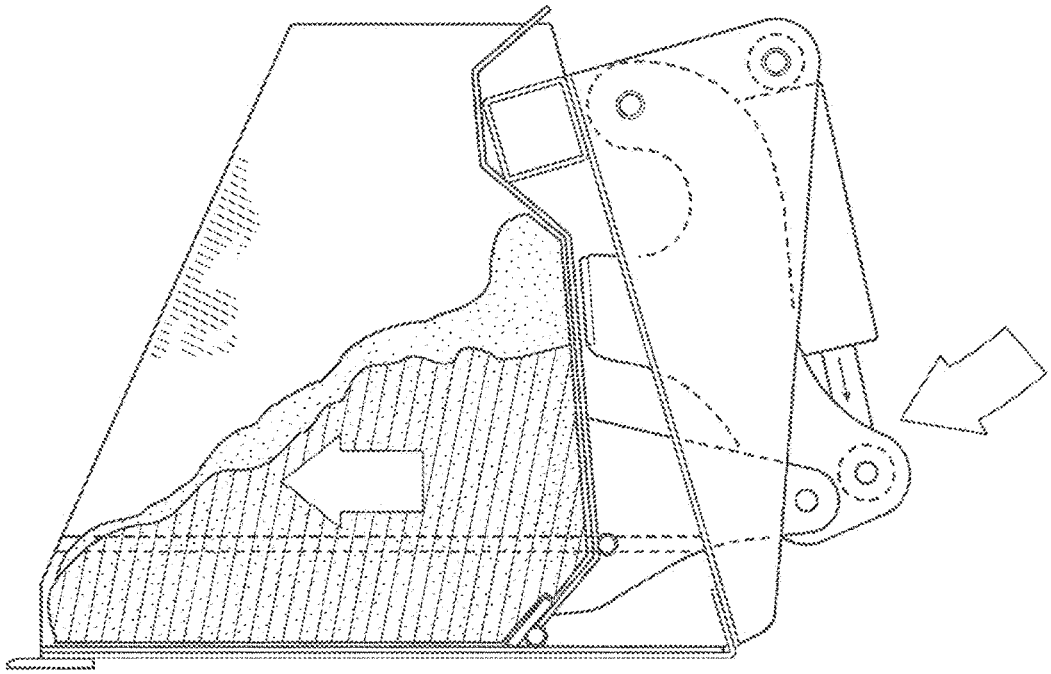
FIG. 4B is an additional illustration of a side view of an example embodiment of a front bucket loader activating the movement to unload material.
Figure 4C:
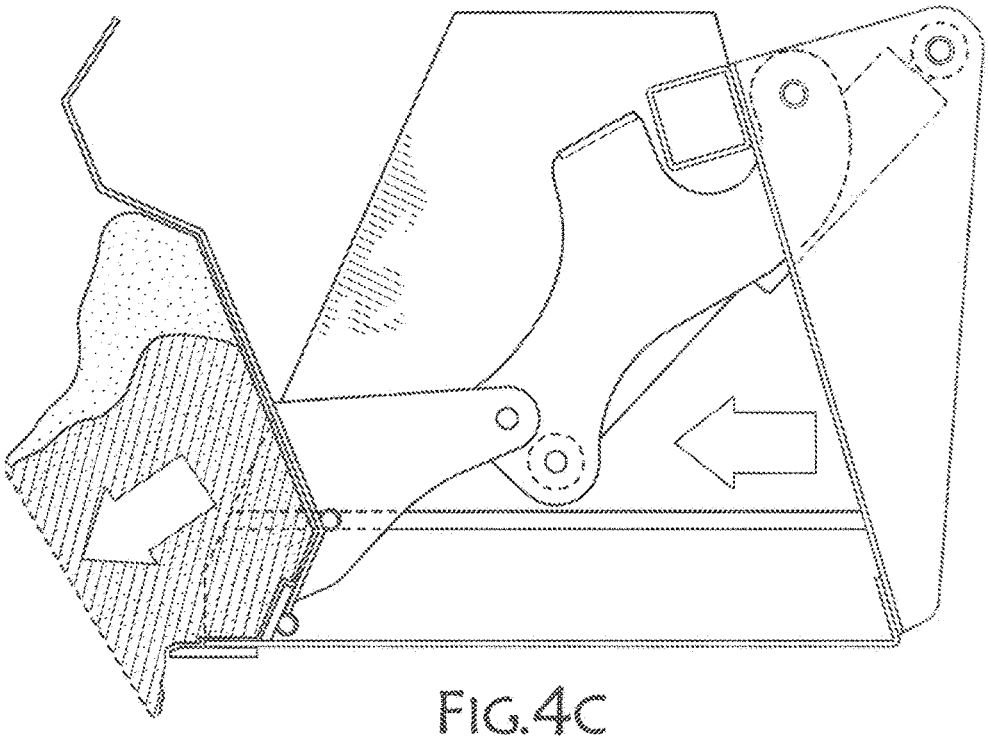
FIG. 4C is an additional illustration of a side view of an example embodiment of a front bucket loader at a full state of activation in unloading material.
Figure 4D:
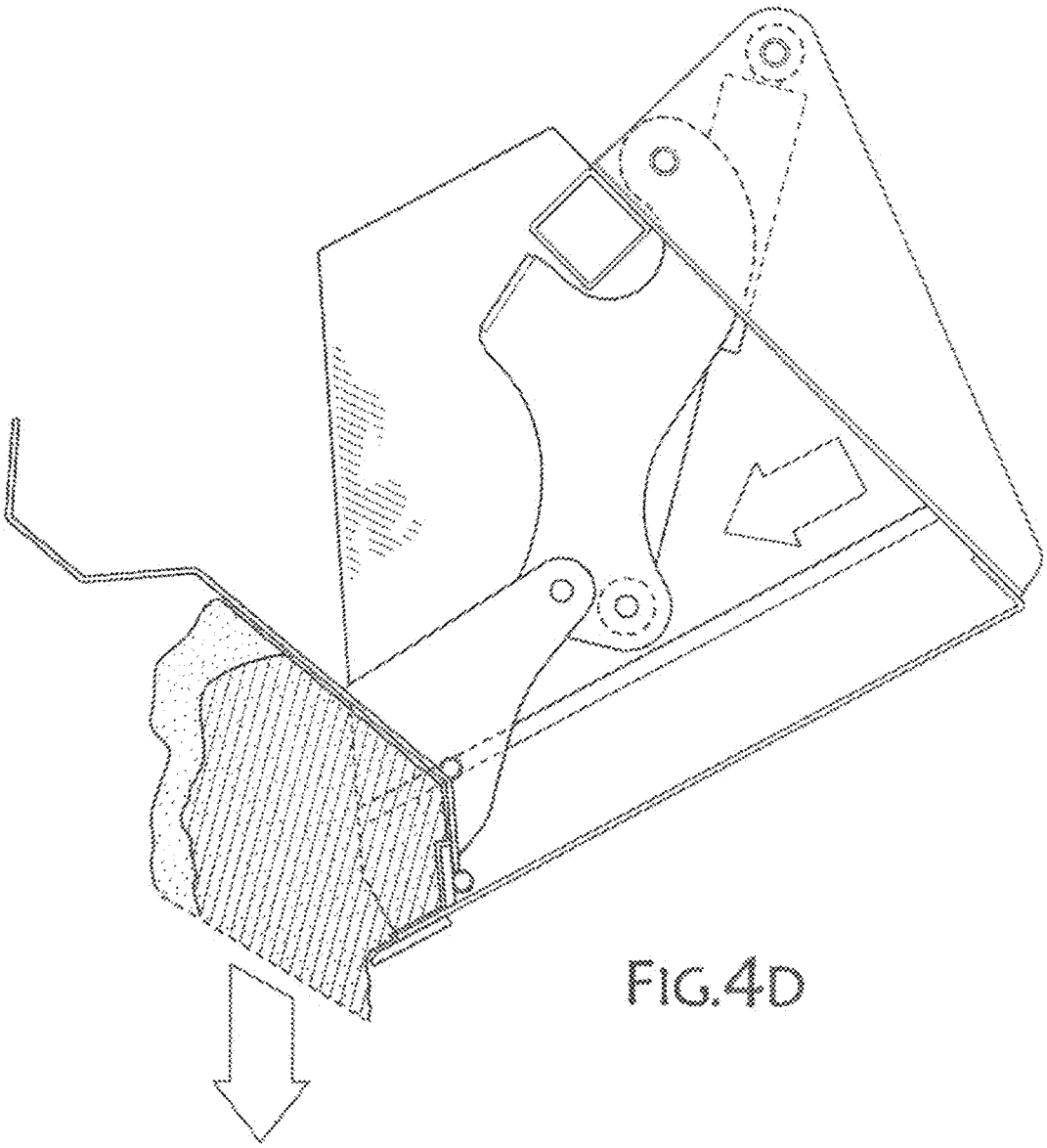
FIG. 4D is an additional illustration of a side view of an example embodiment of a front bucket loader at a state of activation and tilt in unloading material.

Turning to FIGS. 4A-D, illustrating an additional example embodiment of the front bucket loader ejecting material in a series of illustrations (FIGS. 4A-D). Notably, the front bucket in the following illustrations is configured with a back wall alignment bar 402, also known as a pivotable serpentine back wall alignment bar 402. FIG. 4A is an illustration of a side view of an example embodiment of a front bucket loader in a retracted position. FIG. 4B is an illustration of a side view of an example embodiment of a front bucket loader activating the movement to unload material. FIG. 4C is an illustration of a side view of an example embodiment of a front bucket loader at a full state of activation in unloading material. FIG. 4D is an illustration of a side view of an example embodiment of a front bucket loader at a state of activation and tilt in unloading material.

In FIGS. 4A-D, the alignment bar 402 is a metal alloy bar configured to the left and right side walls of the front bucket, wherein the alignment bar helps to align the pivotable serpentine back wall 426 as it moves from a retracted state to a protracted state. The alignment bar 402 functions as either a rail system wherein a rod slides beneath it, or it may be formed as a groove into the pivotable serpentine back wall 426, wherein it also forms a guide. In other embodiments, e.g. FIGS. 3A-D the alignment bar 402 is not required due to the weight of the material and the geometry of the front bucket. For example, the left and right side walls may be angled inwards toward the center of the bucket, so that the pivotable serpentine back wall forms a wedge wherein it is bound by the side walls to move in a lateral direction. Therefore, horizontal movement is limited due to the side walls forming a geometry that holds the pivotable serpentine back wall into place. In yet further embodiments, the pivotable serpentine back wall is weight at the lower portion wherein the weight of the back wall itself holds the element in position as it moves from a retracted state to a protracted state.

Figure 5:
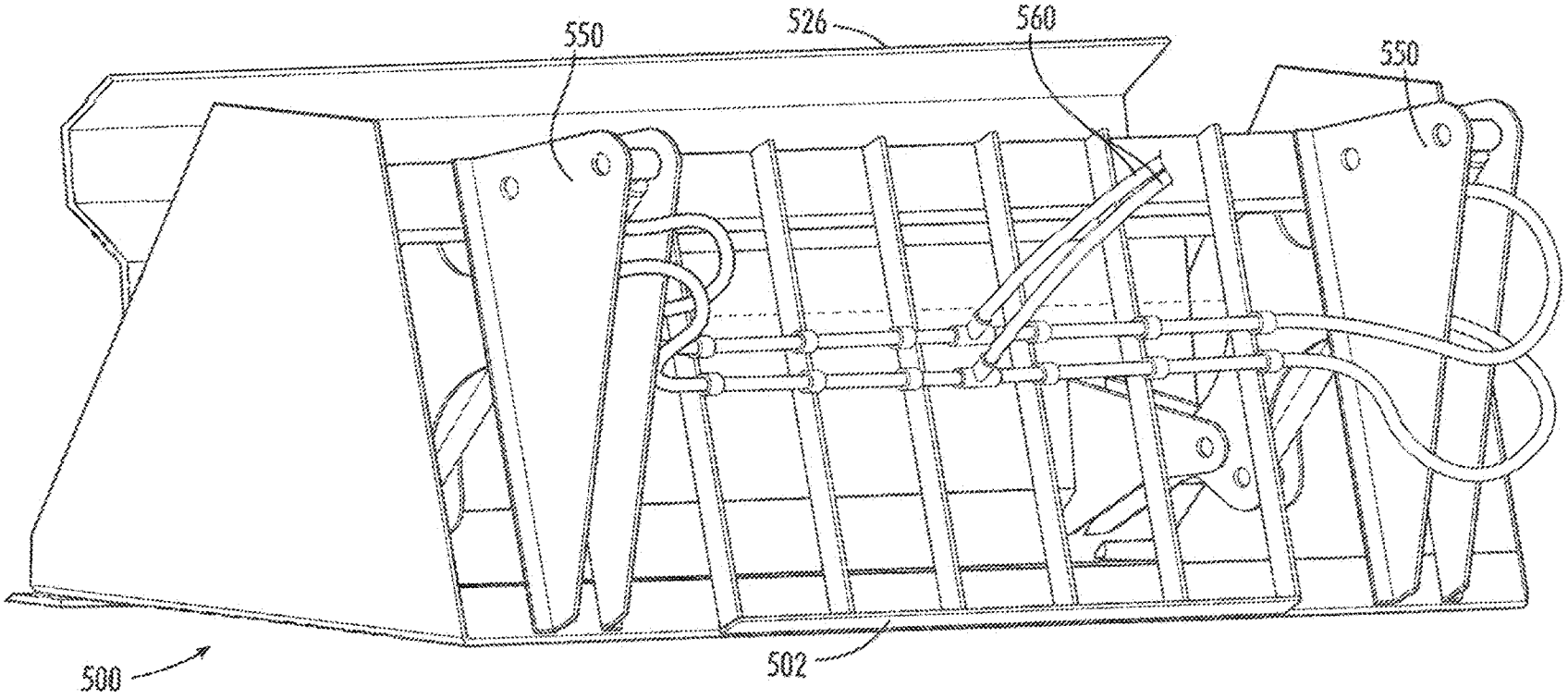
FIG. 5 is an illustration of a back view of an example embodiment of a front bucket loader in a protracted state.

Turning now to the example embodiment in FIG. 5. FIG. 5 is an illustration of a back view of an example embodiment of a front bucket loader in a protracted state. FIG. 5 discloses an example slatted rear mount 502 that serves as a connection point, as well as functions with material handling. The slatted rear mount is situated directly opposing the pivotable serpentine back wall 526. The slatted rear mount 502 adds rigidity to the front bucket loader 500 as well as functions as attachment points for the hydraulic lines and a 3-point adapter (depicted in FIG. 6) for easy mounting to skid steer vehicles. The slatted rear mounts 502 are comprised of a metal alloy or may alternatively be comprised of other metals or polymers that may lower the weight of the apparatus. The slatted rear mounts 502 also provide clipping points for the hydraulic lines 560 to allow for close configuration and to prevent the hydraulic lines 560 from coming into contact with objects within the environment. The environment noted herein is chicken and turkey houses with reduced space restrictions. Turkey and chicken houses have low overhanging items such as feeders, heaters, air units, and other obstacles, wherein the obstacles present danger to objects operating within. The disclosure herein remedies the low overhead clearance by moving the hydraulic assembly and overall profile of the operating equipment of a skid steer to beneath the front bucket to allow for operational safety as well as increased efficiency.

Continuing with FIG. 5, the front bucket loader 500 is displayed in a protracted state wherein the pivotable serpentine back wall 526 is extended from the back edge of the bottom plate. The slatted rear mount 502 is configured to the bottom edge of the bottom plate to add increased rigidity. Further, the rear mounts 550 house the hydraulic piston and accompanying hydraulic lines, wherein the hydraulic piston is protected from damage by the rear mounts 550.

Figure 6:
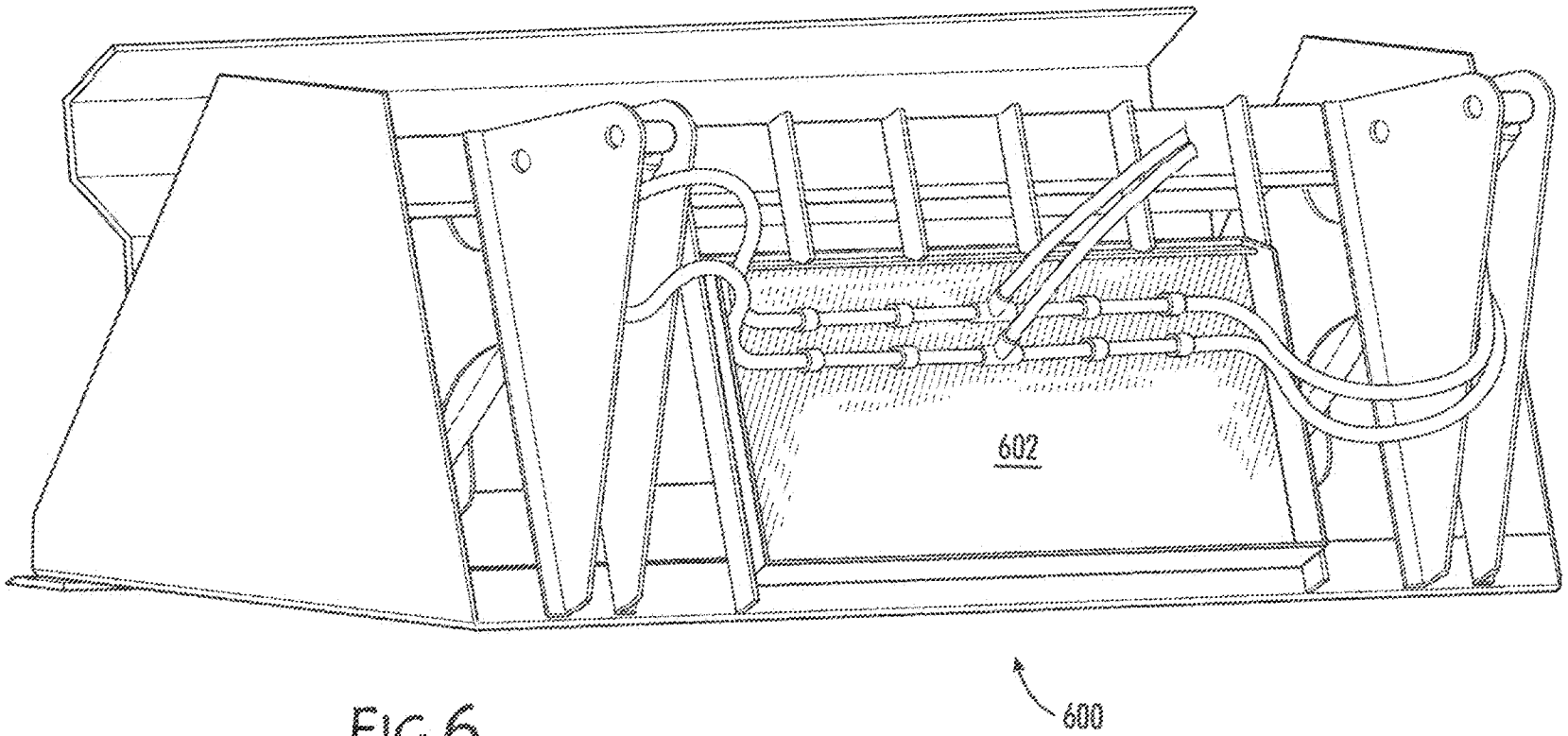
FIG. 6 is an additional illustration of a back view of an example embodiment of a front bucket loader in a protracted state with a 3-point adapter.

Referring now to FIG. 6, an additional embodiment of a front bucket loader. FIG. 6 is an additional illustration of a back view of an example embodiment of a front bucket loader in a protracted state with a 3-point adapter. The 3-point adapter 602 configures to allow rapid connectivity with compact loaders, as well as provides protection for the hydraulic lines. The 3-point adapter is designed to meet ASAE standards for quick hitch accessories. The 3-point adapter 602 is mounted to the slatted rear mount and provides additional support for the front bucket loader 600. The adaptability and configuration of the front bucket loader 600 equipped with a 3-point adapter allow rapid connectivity with exemplary manufactures such as Bobcat™ and Caterpillar™ equipment.

In FIG. 6, the hydraulic lines remain below the pivotable serpentine back wall and well away from low overhead obstacles. Further, the hydraulic lines may be configured and clipped to the 3-point adapter 602 to further secure and protect the lines.

It should be emphasized that the above-described embodiments of the present disclosure are some of the examples of implementations set forth for a clear understanding of the principles of the disclosure. Many variations and modifications may be made to the above-described embodiments without departing substantially from the scope and principles of the disclosure. All such modifications and variations are intended to be included herein within the scope of this disclosure and protected by the following claims.

Therefore, the following is claimed:

1. A front bucket loader apparatus for operating in low overhead space environments, comprising:

(a) a front bucket, comprising:

(i) a bottom plate with a front edge, an opposing back edge, a left edge and an opposing right edge;

(ii) a left side wall attached to the left side of the bottom plate and a right side wall attached to the right side of the bottom plate;

(iii) a top support bracket attached to the left side wall and to the right side wall;

(iv) a pivotable serpentine back wall, the pivotable serpentine back wall having an upper portion and a lower portion, the upper portion being supported by the top support bracket and the lower portion of the pivotable serpentine back wall configured for engaging the bottom plate of the front bucket;

(v) a slatted rear mount directly opposing the pivotable serpentine back wall, wherein the slatted rear mount adds rigidity to the front bucket and lowers weight, and is further configured to protect a hydraulic assembly; and (b) the hydraulic assembly with a profile behind the front bucket attached to and protected within the slatted rear mount of the front bucket and operatively connected to the pivotable serpentine back wall of the front bucket, comprising:

(i) an upper swing arm having a first end and a second end, the first end of the upper swing arm attached to a rear mount of the front bucket, the second end of the upper swing arm attached to a hydraulic piston;

(ii) a lower swing arm having a first end and a second end; the first end of the lower swing arm attached to the second end of the upper swing arm, and the second end of the lower swing arm attached to the lower portion of the pivotable serpentine back wall; and (iii) hydraulic means for moving the upper swing arm in an arcuate path to move the lower swing arm, attached to the pivotable serpentine back wall, along the bottom plate of the front bucket, wherein the hydraulic means is operatively configured below the top of the front bucket.

2. The apparatus of claim 1, wherein the pivotable serpentine back wall of the front bucket has a front edge that is on a pivot mount to allow scraping of the bottom plate when the hydraulic assembly is activated.

3. The apparatus of claim 1, wherein the pivotable serpentine back wall, in a retracted state, is in contact with the first end of the upper swing arm to provide support for the pivotable serpentine back wall of the front bucket.

4. The apparatus of claim 1, wherein the front bucket is comprised of an alloyed steel.

5. The apparatus of claim 1, wherein the front bucket is a maximum of 32 inches in height and 96 inches in width.

6. The apparatus of claim 1, wherein the rear mount protects the hydraulic piston, the upper swing arm, and the lower swing arm.

7. The apparatus of claim 1, wherein the bottom plate is billeted at the portion where the pivotable serpentine back wall is in a fully retracted state to allow for material to fall out and not interrupt the pivotable serpentine back wall from returning to the fully retracted state.

8. The apparatus of claim 1, wherein the front edge of the bottom plate of the front bucket is beveled.

9. The apparatus of claim 1, wherein the front edge of the pivotable serpentine back wall is equipped with a tooth bar.

10. The apparatus of claim 1, wherein the lower swing arm is configured to move along a singles axis as it moves the pivotable serpentine back wall to a protracted or retracted position.

11. The apparatus of claim 1, wherein the front edge of the bottom plate of the front bucket is equipped with a tooth bar.

12. The apparatus of claim 1, wherein the front bucket further comprises a 3-point adapter.

13. The apparatus of claim 1, wherein the left side wall and the right side wall have a pivotable serpentine back wall alignment bar.

* * * * *